US008511769B2

(12) United States Patent
Busalt et al.

(10) Patent No.: US 8,511,769 B2
(45) Date of Patent: Aug. 20, 2013

(54) HOME APPLIANCE WITH IMPROVED RACK SYSTEM

(75) Inventors: Gerhard Busalt, Altenmarkt/Alz (DE); Joachim Grützke, Egmating (DE); Graham Sadtler, Huntington Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 242 days.

(21) Appl. No.: 12/971,098

(22) Filed: Dec. 17, 2010

(65) Prior Publication Data

US 2012/0153794 A1 Jun. 21, 2012

(51) Int. Cl.
*A47B 81/00* (2006.01)

(52) U.S. Cl.
USPC ..... 312/410; 312/334.7; 312/334.21

(58) Field of Classification Search
USPC ..... 312/408, 410, 334.6, 334.7, 334.12, 312/334.8, 334.18, 334.19, 334.21, 334.39, 312/334.41–334.43, 334.33, 334.15, 402, 312/404
See application file for complete search history.

(56) References Cited

U.S. PATENT DOCUMENTS

| | | | | |
|---|---|---|---|---|
| 1,341,829 | A * | 6/1920 | Whittinghill | 126/339 |
| 2,815,649 | A * | 12/1957 | Di Angelus et al. | 312/408 |
| 3,456,996 | A * | 7/1969 | Heiniger-Schar | 312/334.22 |
| 4,659,237 | A * | 4/1987 | Rapp | 384/19 |
| 5,733,026 | A * | 3/1998 | Munachen | 312/334.12 |
| 5,882,100 | A * | 3/1999 | Rock | 312/334.34 |
| 6,132,020 | A * | 10/2000 | Schael et al. | 312/334.1 |
| 6,619,772 | B2 * | 9/2003 | Dierbeck | 312/334.13 |
| 6,909,610 | B2 * | 6/2005 | Cheng | 361/727 |
| 2001/0003407 | A1 * | 6/2001 | Fraccaro | 312/333 |
| 2002/0033657 | A1 * | 3/2002 | Kim et al. | 312/334.12 |
| 2003/0197452 | A1 * | 10/2003 | Kung | 312/334.6 |
| 2004/0000851 | A1 * | 1/2004 | Lam Harn et al. | 312/334.7 |
| 2007/0080616 | A1 * | 4/2007 | Lam et al. | 312/334.6 |
| 2008/0054772 | A1 * | 3/2008 | Koloff et al. | 312/404 |
| 2008/0203875 | A1 * | 8/2008 | Lim et al. | 312/404 |
| 2008/0231155 | A1 * | 9/2008 | Shen | 312/334.8 |
| 2008/0314067 | A1 * | 12/2008 | Lee | 62/441 |
| 2009/0058248 | A1 * | 3/2009 | Gossens et al. | 312/408 |
| 2009/0121599 | A1 * | 5/2009 | Laible | 312/404 |
| 2010/0164341 | A1 * | 7/2010 | Craddock | 312/334.11 |

OTHER PUBLICATIONS

"Built-In Electronic Convention Single and Double Ovens with Steam Assist: Use & Care Guide"; KitchenAide, U.S.A. website: http://www.kitchenaid.com/flash.cmd?/#/product/KEBU208SSS; Sep. 2007.

"Use & Care Guide: Built-In Wall Oven"; Electrolux Home Products, Inc. website: http://www.electroluxappliances.com/kitchen-appliances/wall-ovens/ew30ew65gs. Publication date 2007.

* cited by examiner

*Primary Examiner* — Hanh V Tran
(74) *Attorney, Agent, or Firm* — James E. Howard; Andre Pallapies

(57) ABSTRACT

A home appliance includes a rack that is mounted inside a cavity of the home appliance. The rack is mounted on rails that are located on opposite sidewalls of the home appliance cavity. The rack includes runners that are mounted on the rails. Each of the runners has a channel or aperture that receives one of the rails when the rack is mounted on the rails. One or more protrusions may be disposed on a surface of the channel or aperture of at least one of the runners. The one or more protrusions may be received in a channel formed on a surface of the corresponding rail. The protrusions may be rollers with vertical and/or horizontal axes of rotation.

23 Claims, 11 Drawing Sheets

HOME APPLIANCE WITH IMPROVED RACK SYSTEM

BACKGROUND

Many conventional home appliances, such as ovens and refrigerators, may include one or more racks that are designed to support items within the home appliance. For instance, racks within an oven support food being cooked within the oven. Many home appliance racks are designed to slide within an enclosure, and a rack may be designed to be completely removed. Thus a cook may slide a rack outward from the interior of an oven, place food on the rack, and then slide the rack back in the oven. The interior sidewalls of a home appliance may include a set of rails or ledges to support the racks, and to allow the rack to be slid into and out of the home appliance.

More recently, some home appliances have been augmented with rail and rack systems that facilitate sliding the racks out from and into the interior of the home appliance. One challenge with such rack systems is that the racks may be difficult to disconnect from the interior of the home appliance. Thus, if a cook desires to completely remove a sliding rack from an oven, it may require an increased amount of time and effort to remove the rack. Furthermore, placing the rack back into the oven, especially when there is a large serving of food on it, may be difficult in certain instances (e.g., a 30 lb turkey). Additionally, moving the rack along the rails on the sidewalls of a home appliance cavity may cause the rack to jam if the rack does not remain properly aligned with the rails.

SUMMARY

One aspect of the technology herein may be embodied in a home appliance with an enclosure. The home appliance may include one or more rails on side walls of the enclosure, where a channel is formed in the lower surface of the rail. A support element such as a rack may be configured to be supported by a pair of the rails. The support element may have runners formed into opposite sides of the support element. In certain examples, a channel may be formed in the exterior side of the runner. A runner of a support element may have a projection disposed within the channel. Rails on the sidewall of an enclosure may be received into the channels of the runners at the sides of the support element. The at least one second rail may be received in a runner at a second opposite side of the support element. A projection disposed in the channel of one of the runners may be received in the channel formed in the at least one first rail.

In some example embodiments, the projections may be disposed on upper, lower or side surfaces of a channel in a runner.

In some example embodiments, the projections may be rollers. The rollers may have a horizontal axis of rotation or a vertical axis of rotation.

In some example embodiments, the rollers may be disposed on upper, lower, or side surfaces of the channel in the runner.

In embodiments that include rollers, the rollers biased towards the center of a channel in which the roller is mounted.

In some embodiments, the rails on the sidewalls of an enclosure may have an upside-down "U" shape. In still other embodiments, the rails may have a variety of other geometric shapes. In other embodiments, the rails may have a solid, square, or rectangular profile. In some embodiments, the rails may be separate elements that are affixed to sidewalls of the enclosure. In other embodiments, the rails may be an integral part of the sidewalls.

One aspect of the technology may be embodied in a home appliance having an enclosure. The home appliance may include at least one first rail disposed on a first sidewall of the enclosure, with a channel formed in a bottom portion of the at least one first rail. The home appliance may include at least one second rail disposed on a second sidewall of the enclosure. A support element may be configured to be mounted on the at least one first rail and the at least one second rail. The support element may include a support platform or surface. The support element may include a first runner and a second runner on a first and second side respectively. A first horizontal aperture may be formed into the first runner, with the first rail configured to be received into the first horizontal aperture. At least one projection may be included on a bottom surface that forms part of the first horizontal aperture. The at least one projection may be configured to be received into the channel formed on the bottom of the first rail. The second runner may include horizontal aperture formed in a side of the second runner. The at least one second rail may be configured to be received into the horizontal aperture of the second runner.

DETAILED DESCRIPTION

The various embodiments and/or examples described herein may be implemented in conjunction with other embodiments, e.g., aspects of one embodiment may be combined with aspects of another embodiment to realize yet further embodiments. Independent features or components of a given assembly may constitute additional embodiments.

Figure 1:
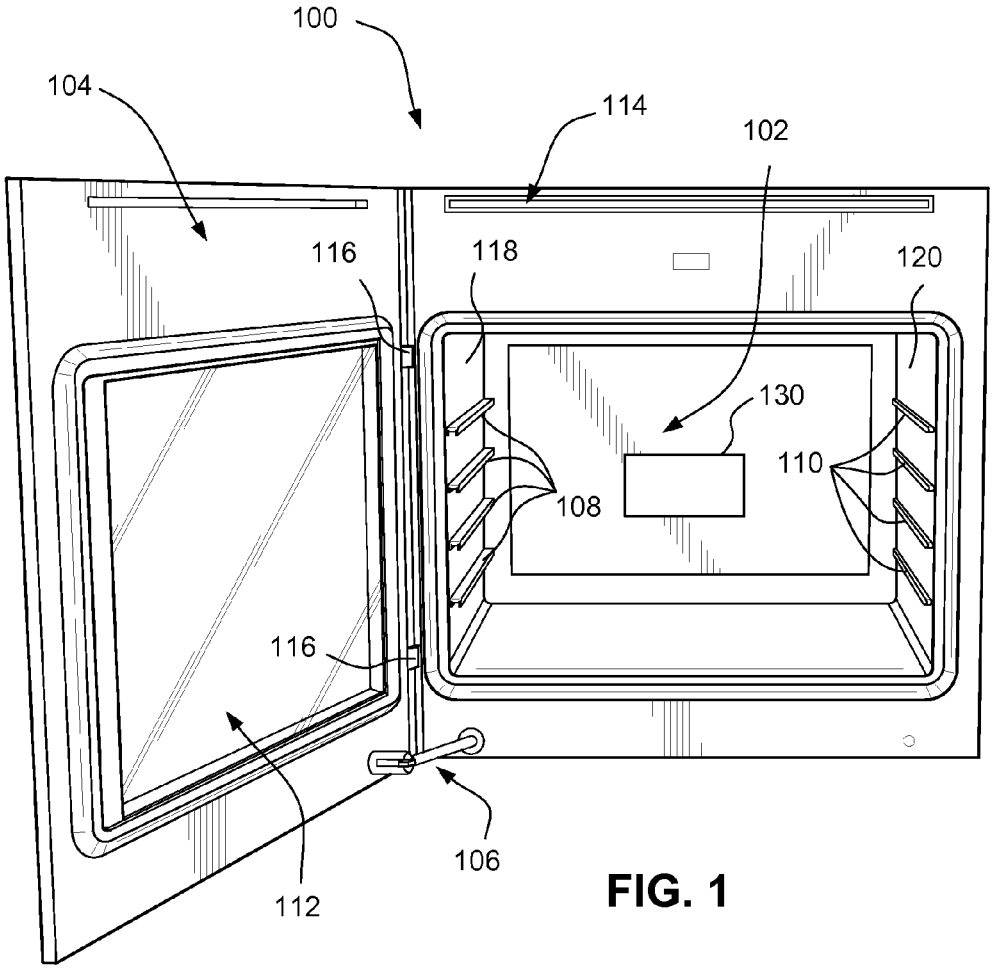
FIG. 1 is an illustrative view of an example of a home appliance according to the present teachings.

FIG. 1 is an illustrative view of an example of a home appliance having rails that are designed to receive and support a movable rack. This example is an oven 100 that includes a cooking enclosure 102. An oven door 104 may be moveably attached to the front of the oven through the use of hinges 116 or the like. A mechanical strut 106 may be provided to limit the movement of the door 104. In some examples, the strut 106 may be connected to a drive unit that automatically opens and closes the door. In certain examples the operational range of motion of the door may be defined by the hinges 116 connecting the door 104 to the cooking enclosure 102. In certain examples the door may be a sliding door that slides between open and closed positions (e.g., such that hinges may not be needed).

The oven door 104 may have a viewing insert 112. Such a viewing insert may allow, for example, a cook to look into the cooking enclosure 102 to view food that is being cooked via heating element 130. Viewing insert 112 may be constructed by conventional means such that the insert is able to withstand the temperature differential between the inside of the cooking enclosure 112 (e.g., 400° F.) and an external normal temperature. Viewing insert 102 may be constructed out of two glass substrates such as, for example, borosilicate glass substrates or the like. The front panel of the cooking enclosure 102 may include a vent 114 to facilitate cooling of the oven 100.

Rails 108 are disposed along the left inner sidewall 118 of cooking enclosure 102. In this embodiment, the rails 108 have an inverted "U" shape. In other examples, discussed below, rails may be other shapes. Opposite the inverted U-shaped rails 108 are solid rails 110 disposed on the right inner sidewall 120 of the cooking enclosure. In operation, corresponding pairs of the U-shaped rails 108 and solid rails 110 are structured to support a rack that may be inserted into the cooking enclosure. It will be appreciated that the positioning of the rails may be switched. For example, U-shaped rails may be placed on the right inner side wall and solid rails place on the left inner side wall. Alternatively, or in addition, either, or both, of the rails may have curved shaped leading edges that facilitate insertion of a rack onto the rails.

In certain examples an oven may include a heating element (e.g., a burner) disposed on a lower portion of a cooking cavity in the oven. The heating element disposed on a lower portion of the cooking cavity may facilitate the baking or roasting of food placed into the oven. Alternatively, or in addition, an oven may include a heating element disposed on a top portion of the cooking cavity. Such an upper heating element may allow food placed into the oven to be "broiled". An oven may include a fan disposed in the cooking enclosure to facilitate the movement of hot air around the cooking enclosure. This convection process may speed up the cooking of food placed into an oven.

The heating elements for an oven may be hooked up to an electrical grid or may be connected to another heating source such as natural gas, propane, or the like. The heat provide by heating elements disposed in a cooking cavity of an oven may be controlled by a thermostat provided on an outer surface of the oven. Accordingly, users may control the temperature of the cooking cavity. Control of temperature or other oven functionality (e.g., whether the upper broiler burners are on) may be provided by mechanical switches, electrical connections, or the like. Control may be presented to the user in the form of mechanical dials, a touch screen, etc. In certain instances (e.g., an oven with a touch screen) the oven may require an electrical connection to power certain features of the oven.

In certain examples an oven may include a timer that allows timed control of oven functionality. For example, an oven may have a timer that sets the oven to "bake" at 425° for 30 minutes. After 30 minutes the timer may automatically cause the oven to turn off. In certain examples an oven may include preset cooking times for a variety of different types of food (e.g., 350° for 15 minutes for steak or 425° for 12 minutes for salmon).

In certain example ovens may include an auto-clean functionality. One technique for accomplishing this is to oxidize the organic matter in the cooking cavity through use of extreme heat (e.g., at a temperature in excess of 500° F.).

In other examples an oven may be a microwave oven that uses microwave radiation to heat food. An example microwave oven may include a magnetron used to convert electrical energy into microwave radiation. In certain examples a microwave oven may include a stirrer and/or a turntable to facilitate even distribution of microwave energy. In certain examples a microwave oven may also include a convection process.

The subject technology may also be applied to other types of home appliances. For example, another type of home appliance is a dishwasher. In examples, a dishwasher may be connected to a water source. In certain examples a dishwasher may include a heating element for heating items within the dishwasher to speedup the drying process after the items have been washed.

In certain examples, a home appliance (e.g., an oven or a clothes dyer) may require electrical power to be supplied at higher than normal household voltage. For example, an electrical connection of 240V may be preferred or required over a standard 120V connection.

In examples, a home appliance may be configured to receive one item or multiple items into an enclosure of the home appliance. The received item(s) may then be subject to a function performed by the home appliance (e.g., cooking/heating food in an oven, drying clothes in a clothes dryer, or washing dishes in a dishwasher). In certain examples a home appliance may perform multiple functions on the items located within the enclosure. For example a dishwasher may wash and then dry dishes located within the enclosure.

Figure 2A:
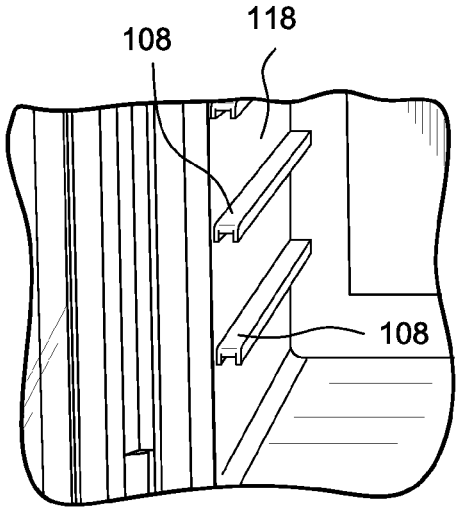
FIG. 2A is a detailed perspective view of rails located on one sidewall of the home appliance illustrated in FIG. 1.
Figure 3A:
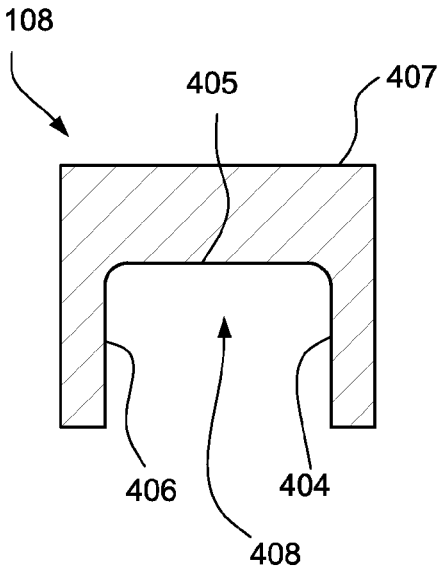
FIG. 3A is an illustrative cross-sectional view of a rail of FIG. 2A.

FIG. 2A is a detailed perspective view of the U-shaped rails 108 mounted on the left inner sidewall 118 of the cooking enclosure 102. FIG. 3A is an illustrative cross-sectional view of one of the rails 108 of FIG. 2A. As illustrated, a rail channel 408 extends along substantially the entire length of the underside of each rail 108. The rails 108 may be formed as a single unitary body, and/or may be constructed from multiple separate elements that are affixed to each other. Rails 108 have an upper outer portion 407. Rails also have a first portion 406 and a second portion 404 that may be parallel to each other. Rails 108 may also include an upper inner portion 405. Upper inner portion 405 may be substantially transverse to the first and second portions 406 and 404. The first and second portions 406 and 404, along with the upper inner portion 405 may form a rail channel 408 that extends along the rail 108.

Figure 2B:
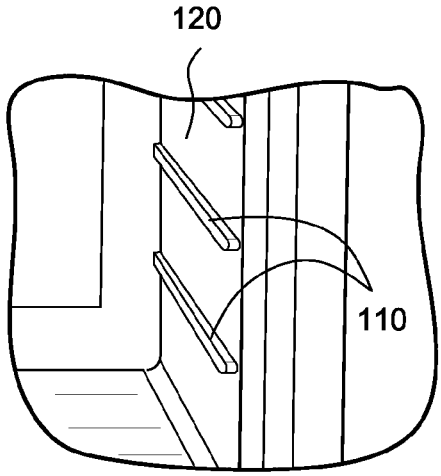
FIG. 2B is a detailed perspective view of rails located on the other sidewall of the home appliance illustrated in FIG. 1.
Figure 3B:
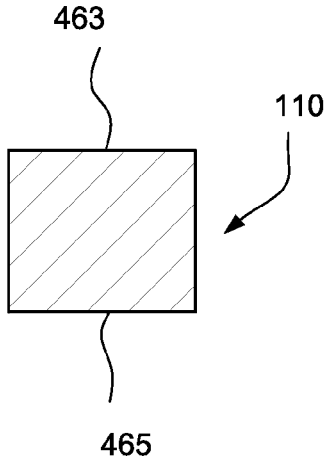
FIG. 3B is an illustrative cross-sectional view of a rail of FIG. 2B.

FIG. 2B is a detailed perspective view of the rails 110 located on the right sidewall of the home appliance. FIG. 3B is an illustrative cross-sectional view of one of the rails 110 of FIG. 2B. Rails 110 may be solid in profile (e.g., having a generally square or rectangular cross-sectional profile) and extend into and down the right sidewall of the cooking enclosure. The rails 110 may have an upper portion 463 and a lower portion 465. The upper portion 463 and the lower portion 465 may be flat (e.g., such that rails 110 are rectangular in shape) or may be rounded on sides, the top, and/or bottom.

In the example illustrated in FIGS. 2A and 2B, the rails 108, 110 are separate elements that are affixed to the sidewalls of the oven. In other embodiments, the rails 108 and 110 may be integral portions of the sidewalls of the home appliance.

Figure 13:
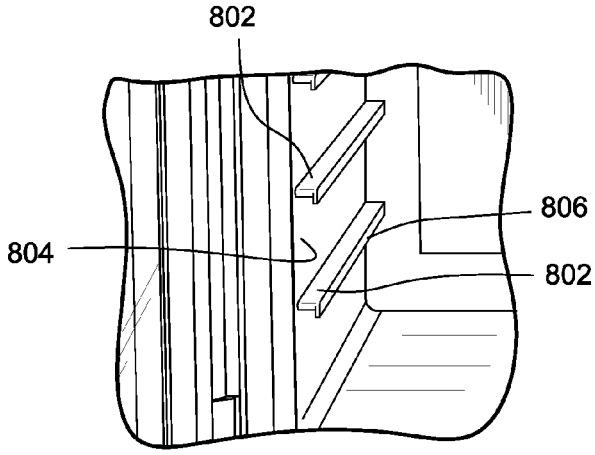
FIG. 13 is an illustrative view another example of a rail mounted on the sidewall of a home appliance.

In other examples, a portion that defines the rail channel 408 may be formed from the sidewall (e.g., 118 or 120 in FIG. 1) of a home appliance. For example, FIG. 13 shows a detailed view of L-shaped rails 802. In this example, a channel of the rail 802 is defined partly by the sidewall 804 of the home appliance to which the rail 802 is connected (e.g., the channel in FIG. 13 may correspond to the rail channel 408 where the sidewall 804 functions as the first portion 406) and partly by a second portion 806 of the rail 802.

The rails 108, 110 may be constructed out of various materials such as, steel (or other suitable metals), glass, ceramics, plastics or other materials suitable for the environment in which the rails will be located. For example, when placed into an oven, the rails may be constructed out of a material suitable for high temperature variation environments (e.g., stainless steel or the like). If rails are to be used in a dishwasher, materials that are highly resistant to water, such as, for example, synthetics, may be used.

Figure 12:
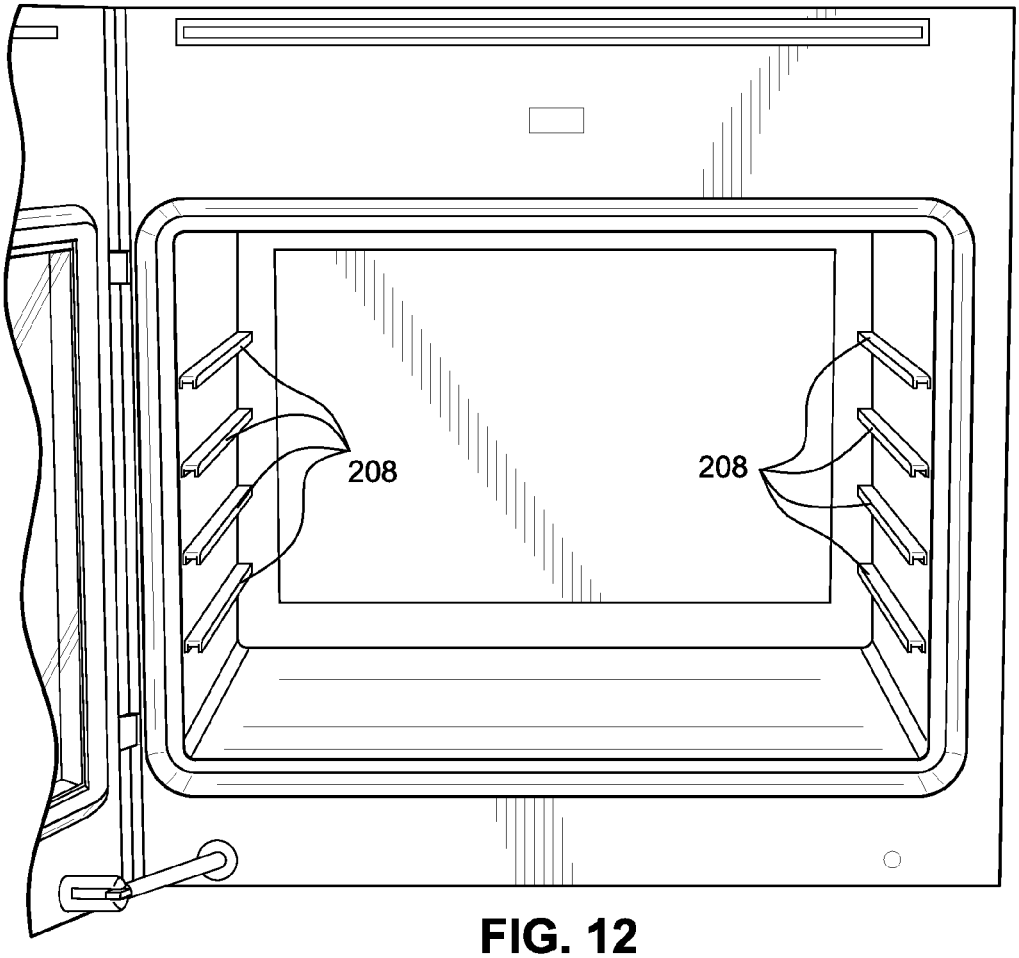
FIG. 12 is an illustrative view of another example of a home appliance.

FIG. 12 is an illustrative view another example. In this example, the rails 208 disposed on both the left and right sidewalls are U-shaped. It will be appreciated that other types of rails may also be disposed on both sides of an enclosure in a home appliance. For example, rails 802 as shown in FIG. 13 or rails 110 as shown in FIG. 2B may be disposed on both the left and right sidewalls of an enclosure in a home appliance. In certain examples, one set of rails may have a solid profile and one set of rails may have a U shaped profile.

While multiple rails have been shown and described in the examples illustrated in FIGS. 1 and 12, any suitable number of rails may be placed into a an enclosure of a home appliance. For example, an enclosure may have one rail disposed on each sidewall, or multiple rails at differing heights, etc.

Figure 4A:
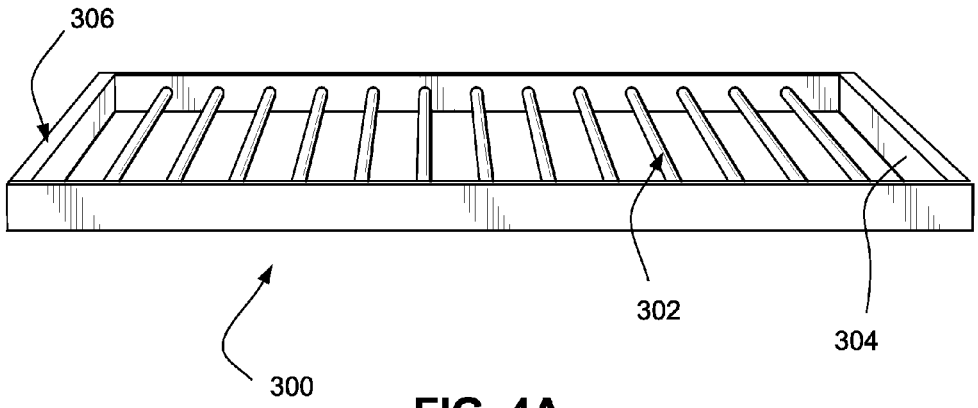
FIG. 4A is an illustrative view of an exemplary rack that fits inside a home appliance as illustrated in FIG. 1.

FIG. 4A is an illustrative view of a rack that can be mounted on the rails of a home appliance. The rack 300 is dimensioned such that it fits between the side, front and rear walls of the home appliance enclosure. The rack 300 includes a left runner 306 and a right runner 304 configured to engage with the rails on the sidewalls of a home appliance enclosure. In the example illustrated in FIG. 4A, bars 302 run from the front to the rear. In certain examples, the bars could run from the left to the right sides of the rack. In other examples, the rails could run in different or in multiple different directions. In other examples, the bars could be replaced with a solid surface, or with a surface having a plurality of apertures or channels formed therein. In certain examples, the runners 304 and 306 may be integrated into the body of the rack 300 such that the runners and the rack 300 are one unitary body. In other examples the runner 304 and/or 306 may be constructed separately from the rack and then affixed or mounted to the rack through welding, glue, bolts, screws, or the like.

Figure 4B:
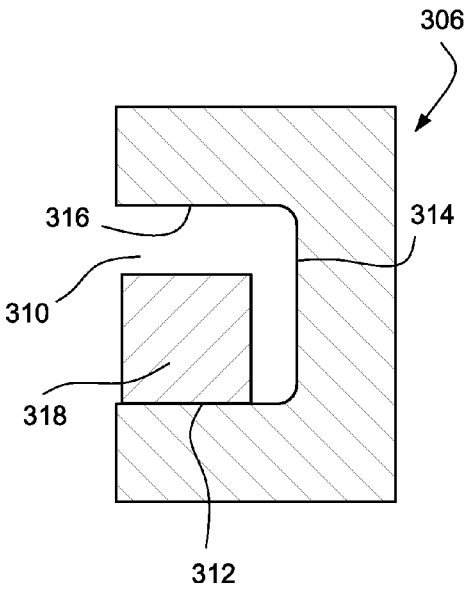
FIG. 4B is an illustrative cross-sectional view of a runner of the rack shown in FIG. 4A.

FIG. 4B is an illustrative cross-sectional view of the runner 306 in FIG. 4A. The runner 306 includes a channel 310 that may extend along the depth of the rack 300. The channel 310 may be formed by an upper surface 316, a side surface 314 and a lower surface 312. In certain examples, the channel 310 is transverse to the rail channel 408. Disposed on the lower surface 312 may be a protrusion 318 (discussed in more detail below).

Figure 4C:
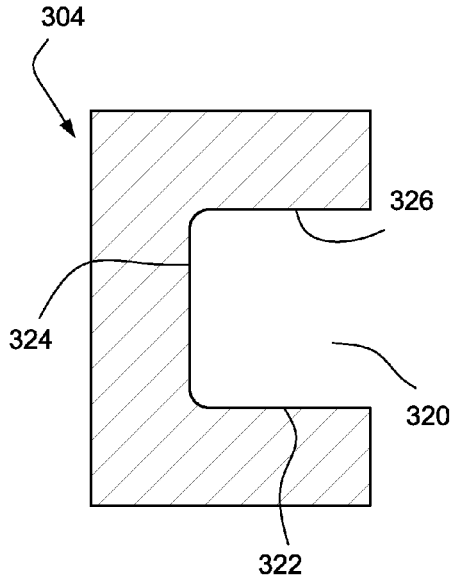
FIG. 4C is an illustrative cross-sectional view of another runner of FIG. 4A.

FIG. 4C is an illustrative cross-sectional view of the runner 304 of FIG. 4A. The runner 304 includes a channel 320 that may extend along the depth of the rack 300. The channel 320 is formed by an upper surface 326, a side surface 324 and a lower surface 322.

FIGS. 5A-11C are illustrative views showing exemplary runners and/or protrusions of racks that are configured to interact with various exemplary shaped rails (e.g., rails as illustrated in FIG. 2A or FIG. 2B). The runners (e.g., runner 410 in FIG. 5B) may have ends 402 that act as stoppers to prevent the racks from being pushed in too far into an oven. Alternatively, or in addition, the rails disposed in an enclosure of a home appliance may be structured to prevent the rack and its corresponding runners from being pressed too far into the oven. For example a rail may include a stopper at the end of the rail, thus being configured to prevent a runner from pressing against the back of an oven or other home appliance.

Example runners may include a horizontal channel (or aperture) configured to receive an example rail that is positioned on the sidewall (described above) of a home appliance. A horizontal channel may be formed as shown in FIG. 4B or FIG. 4C (e.g., 310 or 320). As discussed below, example channels may be rectangular, curved, or other shapes or geometries.

Figure 5A:
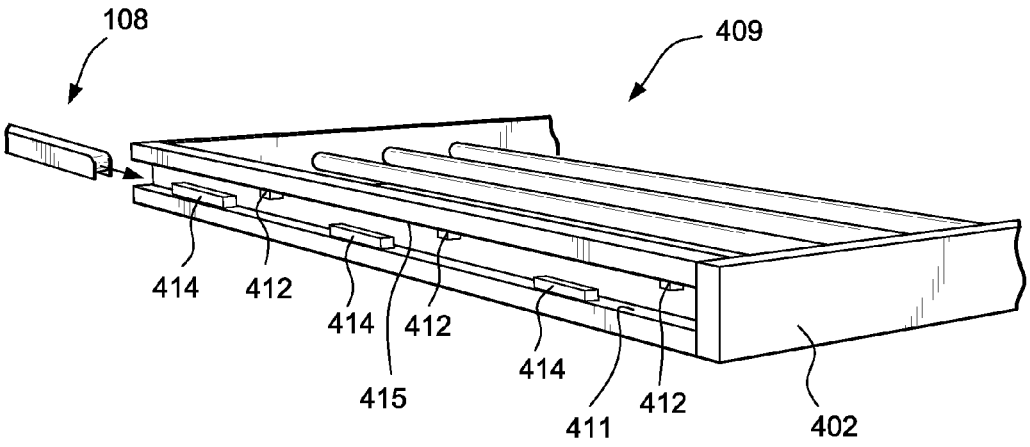
FIG. 5A is an illustrative perspective view showing an example of a runner for an example rack configured to interact with an example rail as shown in FIG. 2A.
Figure 5B:
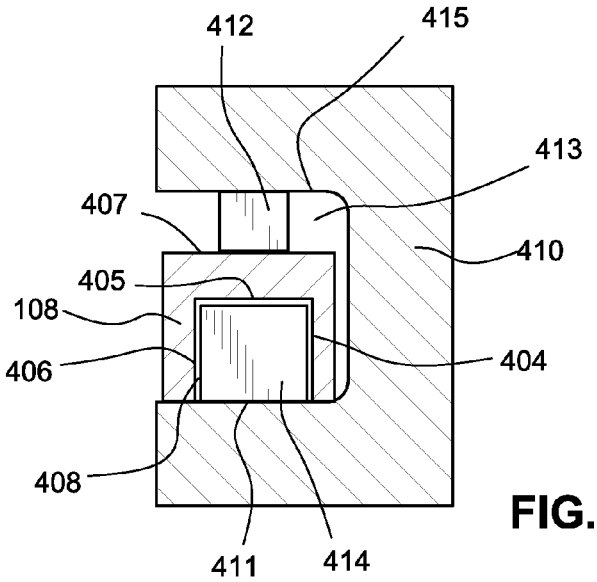
FIG. 5B is an illustrative cross-sectional view of the number of the rack shown in FIG. 5A.

FIG. 5A is an illustrative perspective view showing an example of a runner for an example rack configured to interact with the example rail shown in FIG. 2A. FIG. 5B is a corresponding cross-sectional view of the runner and rail in FIG. 5A. The rack 409 has one or more upper protrusions 412 disposed on the upper surface 415 that partly defines the horizontal channel 413. The upper protrusions 412 extend downward from the upper surface 415 of the horizontal channel such that they can bear against and engage along the top surface 407 of a rail 108.

It will be appreciated that the protrusions disposed on example runners may be disposed in a variety of configurations. For example, as shown in FIG. 5A the protrusions 412 and 414 are in a staggered formation. Alternatively, or in addition, the protrusions may be aligned with each other along an axis that is perpendicular to the upper and lower surfaces (e.g., such that one protrusion is directly above the other—for example, the first two rollers that interact with the rail 110 shown in FIG. 10A). In certain examples, multiple protrusions on one surface of a runner may be disposed between the protrusions disposed on the other surface of a runner (e.g., rollers 454 between rollers 456 in the example shown in FIG. 9A).

The rack illustrated in FIG. 5A also includes bottom protrusions 414 that extend upwards from the bottom surface 411 that partly forms the horizontal channel 413. The bottom protrusions 414 are configured to be received in the rail channel 408 formed on the bottom of the rail 108. The bottom protrusions 414 may have a width that facilitates their placement in the rail channel 408 of the rail 108. In other words, in certain examples, the width of the bottom protrusions 414 may be slightly less than the width of the rail channel 408 (e.g., the distance between the first and second portions 406 and 404) on the bottom of the rail 108. The bottom protrusions 414 may be structured to engage with any or all of the surfaces of the rail channel 408 (e.g., portions 404, 405 and 406 described above).

In the example illustrated in FIG. 5A, the bottom protrusions 414 are rectangular shaped. In alternate examples, the bottom protrusions 414 could have other shapes, so long as the protrusions could still be received in the rail channel 408 formed on the bottom of the rail 108. In certain examples, the multiple bottom protrusions 414, as illustrated in FIG. 5A, could be replaced with a single continuous protrusion. The continuous protrusion could have a rectangular shape, or any other shape that allows it to be received in the rail channel 408 on the bottom of the rail 108.

The bottom protrusions 414 may be separate elements that are affixed to the lower surface 411, such as by fasteners, gluing, welding, or the like. Alternatively, or in addition, the bottom protrusions 414 may be part of the structure of the runner of the rack. For example, the bottom protrusions 414 may be formed by an extrusion process.

In certain examples, the runner 410 may be made of durable, low cost materials, and the protrusions may be made of a material with a low coefficient of friction. For instance, the bottom protrusions 414 may be formed of a highly polished metal material designed to reduce the friction that will be generated between the bottom protrusions 414 and the rail channel 408 on the bottom of the rail 108.

Figure 6:
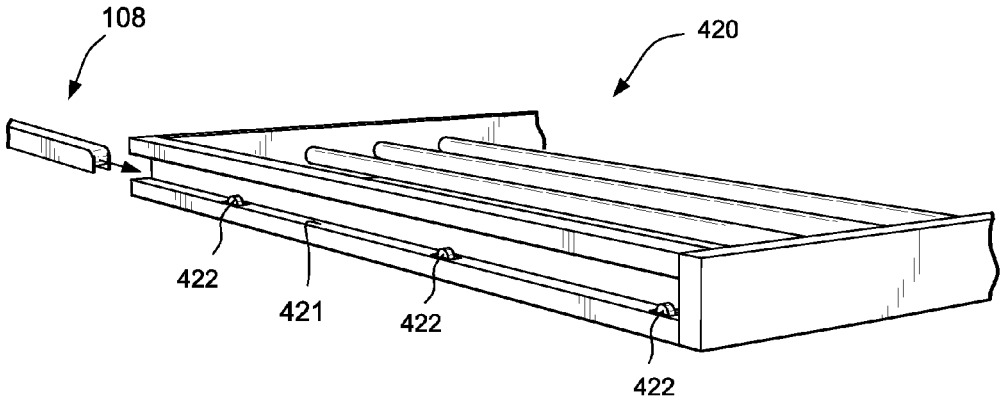
FIGS. 6-8 are illustrative perspective views showing examples of runners for example racks configured to interact with the example rail shown in FIG. 2A.

FIG. 6 illustrates an alternate example of a rack 420 that includes a plurality of rollers 422 disposed on the lower surface 421 of the horizontal channel. The rollers 422 have an axis of rotation that is substantially horizontal (e.g., parallel) to the lower surface 421. The rollers 422 may facilitate the movement of rack 420 along the rail channel 408 of the rail 108. In this example, the upper portions of the rollers 422 that protrude from the lower surface 421 of the horizontal channel are received in the rail channel 408 on the bottom of the rail 108. The rollers 422 may be disposed within the structure of the runner such that the height (e.g., in a direction perpendicular to the lower surface 421) of the rollers above the lower surface 421 on the runner is approximately equal to the height of the channel 408 on the bottom of the U-shaped rail. Likewise, the width of the rollers 422 (e.g., in a direction parallel to the plane of the lower surface 421) may be just slightly less than a width of the rail channel 408 on the bottom of the rail 108.

Figure 11A:
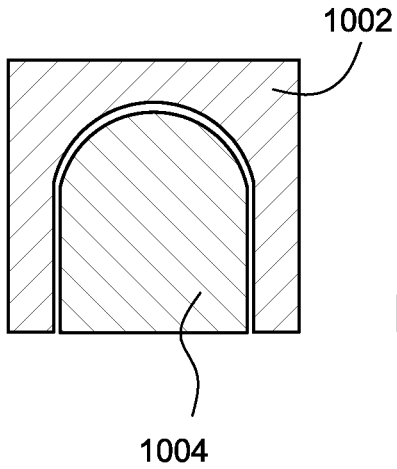
FIGS. 11A-11B are illustrative cross-sectional view of example protrusions engaging with example rails.
Figure 11B:
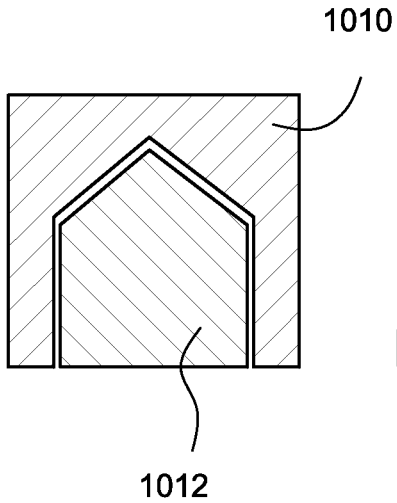

In some examples, the profile of the protrusions of a runner may be designed to match a profile of a rail channel in an example rail. For example, FIGS. 11A and 11B show example shapes for example protrusions. In FIG. 11A curved protrusion 1004 may be structured to have a curved top section. Rail 1002 may likewise have a corresponding curved underside in the rail channel to receive the curved protrusion. FIG. 11B shows another example where a protrusion 1012 has a pointed top surface that is structured to engage a rail 1010. Thus, matching the profile on the protrusions to the rail may serve to guide and stabilize the rack as it is moved along the rails. In certain examples, the protrusions may be rotatable like the rollers 422 shown in FIG. 6.

Figure 7:
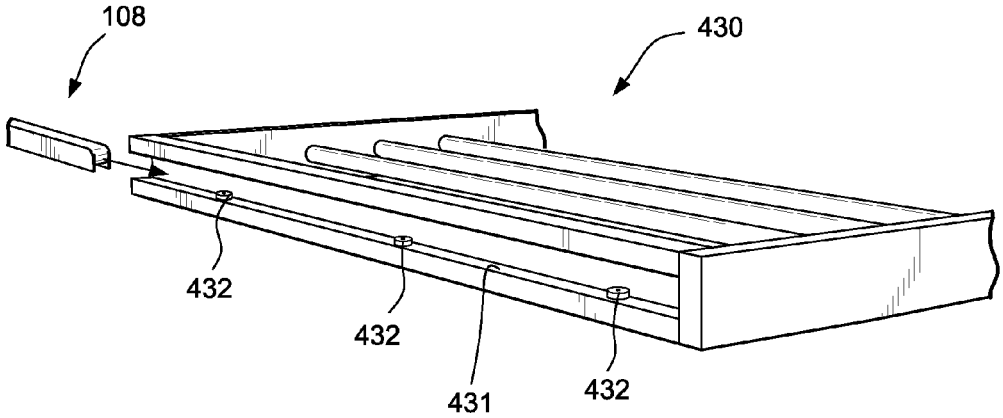

FIG. 7 shows an example of a rack 430 which has rollers 432 mounted on the lower surface 431 forming a part of the horizontal channel. In this example, the rollers 432 have an axis of rotation that is perpendicular to the plane of the lower surface 431. This arrangement of rollers 432 may facilitate the rolling of rollers 432 along the first portion 406 and the second portions 404 of the rail channel 408 on the bottom of the rail 408. As a result, the rollers 432 may assist in guiding the rack 430 straight forward and backward as the rack is moved along the rails.

Figure 8:
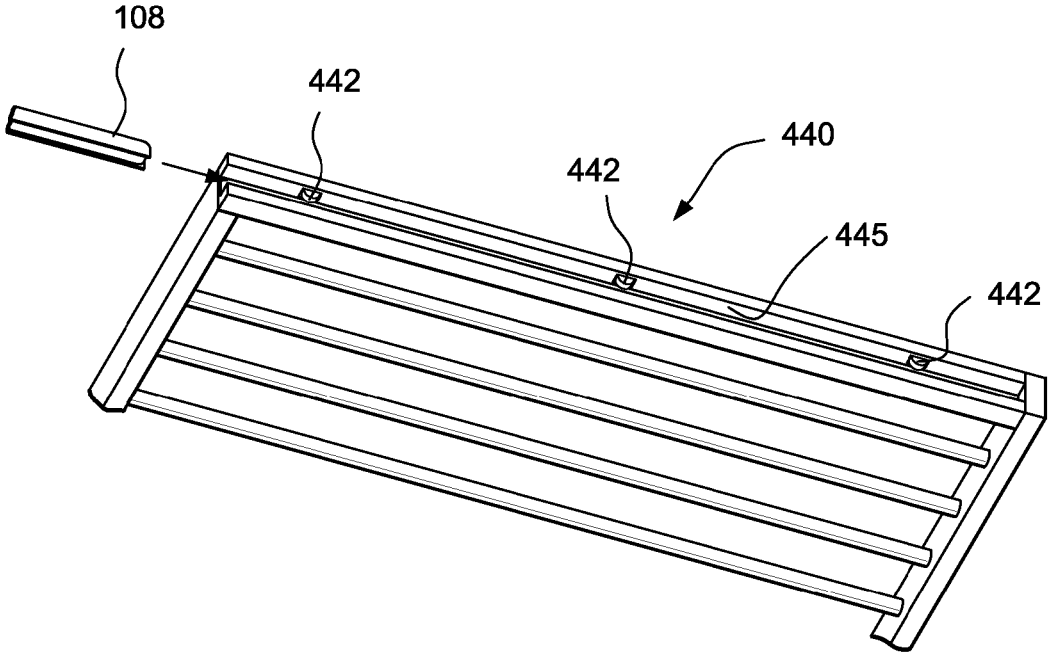

FIG. 8 illustrates how rollers 442 may be mounted on the upper surface 445 of the horizontal channel of a runner of a rack 440. The rollers 442 have an axis of rotation that is substantially parallel to the upper surface 445. Accordingly, the rollers 442 may roll along the upper outer portion 407 of the rail 108. It will be appreciated that rollers disposed on an upper surface of a horizontal channel of a runner of a rack may also be used conjunction with rollers that are disposed on a bottom surface of the horizontal channel (for example, in conjunction with the rollers shown in FIG. 6 or 7).

Figure 9A:
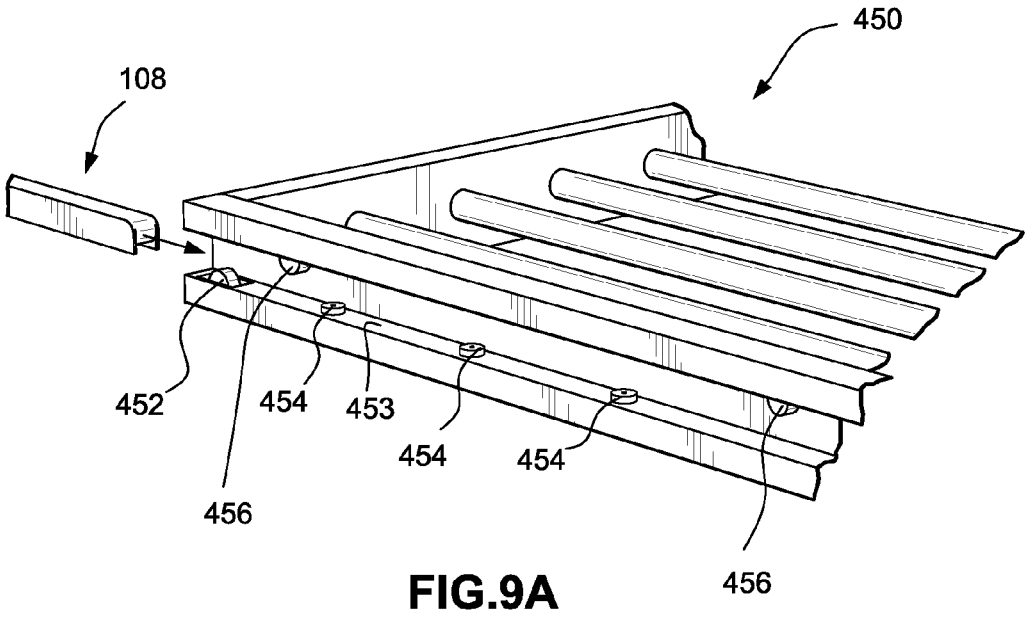
FIG. 9A is an illustrative perspective view showing an example of a runner for an example rack configured to interact with an example rail shown in FIG. 2A.
Figure 9B:
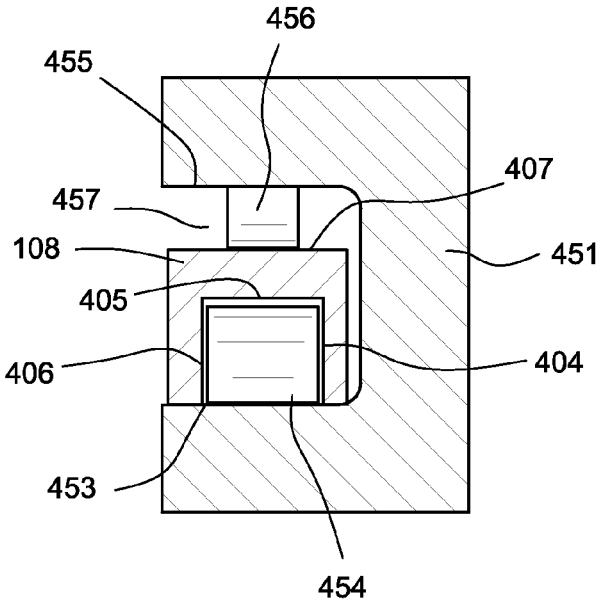
FIG. 9B is an illustrative cross-sectional view of the rail and runner shown in FIG. 9A.

FIG. 9A shows an example of a rack 450. FIG. 9B is an illustrative cross-sectional view of FIG. 9A. In this embodiment, a roller 452 with a horizontal axis of rotation (e.g., parallel to the surface on which it is disposed) is placed at the rear of the lower surface 453 that forms the horizontal channel 457 of the runner 451 of the rack 450. In addition, a plurality of rollers 454, each having a vertical axis of rotation (e.g., perpendicular to the surface upon which the roller is disposed), is disposed along the lower surface 453. The rollers 454 with a vertical axis of rotation, which are configured interact with the first portion 406 and the second portions 404 of the rail channel 408 on the bottom of the rail 108, may facilitate horizontal stability of the rack as it is moved along the rails. Both the first roller 452, with a horizontal axis of rotation, and the plurality of rollers 454, with a vertical axis of rotation, would be configured to be received in the rail channel 408 on the bottom of the rail 108. As noted above, upper rollers 456 may be disposed on the upper surface 455 of the horizontal aperture of the runner. The combination of rollers 452, 454, and 456 interacts with multiple surfaces (e.g., 405, 404, 406, and 407) on the rail 108 to facilitate vertical and horizontal stability of the rack as it is moved along the rails.

Figure 10A:
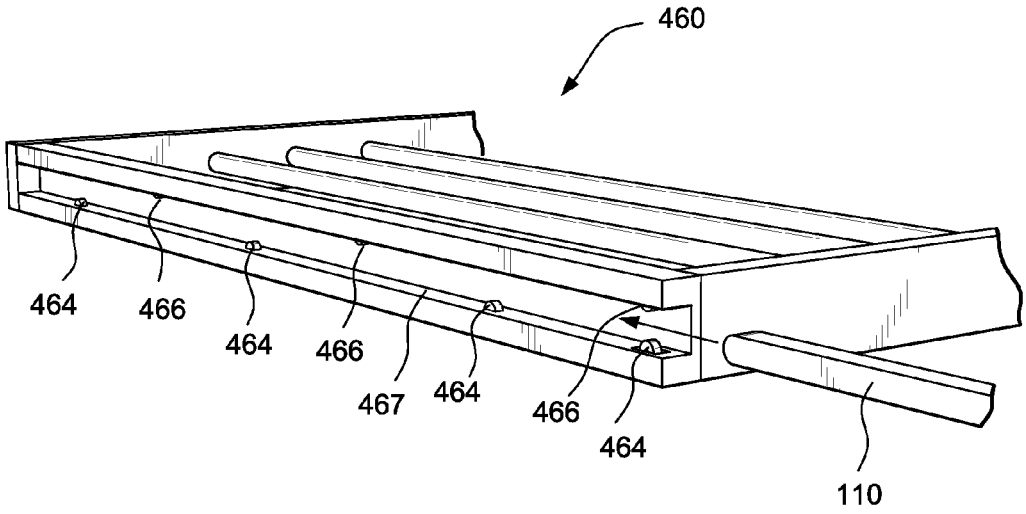
FIG. 10A is an illustrative perspective view showing an example of a runner for an example rack configured to interact with a rail as shown in FIG. 2B.
Figure 10B:
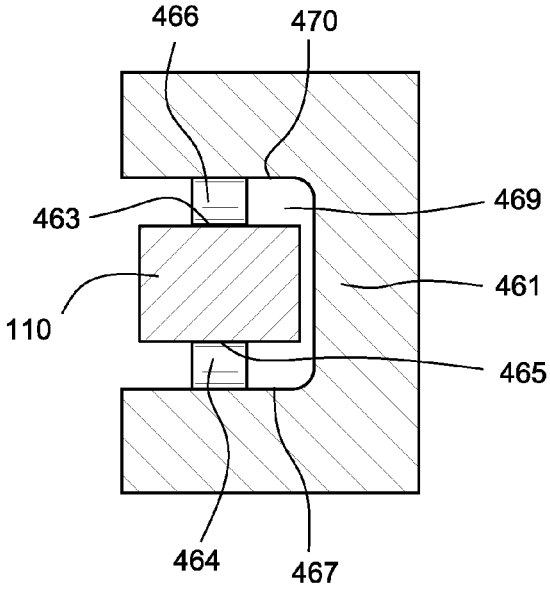
FIG. 10B is an illustrative cross-sectional view of the rail and runner shown in FIG. 10A.

FIG. 10A illustrates a runner of a rack 460 designed to interact with a solid rail 110. FIG. 10B illustrates a cross-sectional view of the rail and runner shown in FIG. 10A. The rack 460 includes rollers 464 that are disposed along the bottom surface 467 that forms part of the horizontal channel 469 of the runner 461. Further, rollers 466 are disposed along the top surface 470 that forms part of the horizontal channel of the runner 461. In operation, the two sets of rollers 464 and 466 may engage the solid rail 110 when rack 460 is being moved along the solid rail 110. In other words, rollers 464 may engage with bottom rail surface 465 and rollers 466 may engage with top rail surface 463. It will be appreciated that the rollers 464 and 466 may facilitate smooth insertion and removal of the rack 460 from a home appliance.

In the examples described above, the rollers may be mounted on a rotational axis that is fixed with respect to the runner. Alternatively, some or all of the rollers may be mounted on rotational axes that are movably mounted on one of the runners. If the rollers are moveably mounted, they may also be biased in a certain direction. For instance, the rollers 464 and 466 in the embodiment illustrated in FIG. 6 may be mounted on rotational axes that are biased toward the center of the horizontal channel on the side of the rack. This may cause the rollers to press against the upper and lower surfaces of the rail 462, facilitating smooth movement of the rack along the rails.

Figure 14:
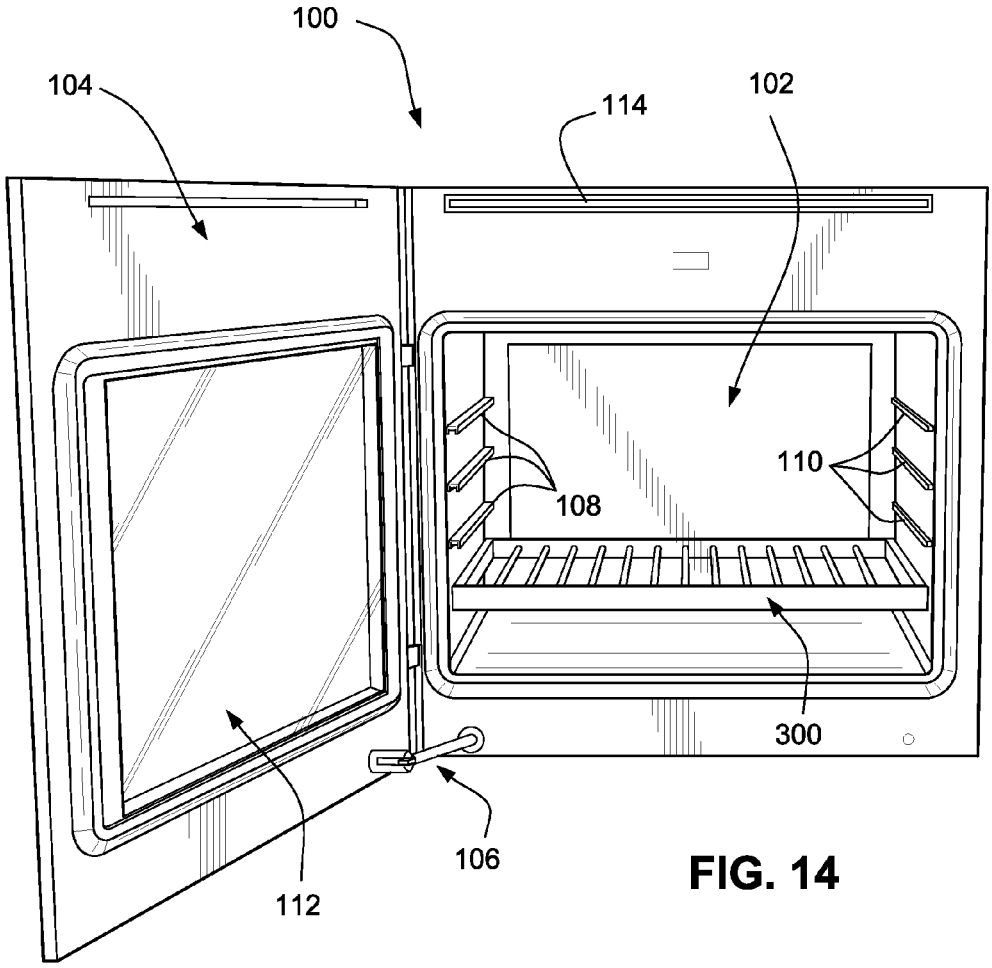
FIG. 14 is an illustrative view of an exemplary home appliance with a rack mounted upon rails located on sidewalls of a cavity within the home appliance.

FIG. 14 is an illustrative view of an oven 100 with rails 108 and 110 configured to receive a rack 300. The rack 300 may have runners in accordance with certain examples.

In some examples, having a U-shaped rail on only one side of the home appliance may be sufficient to provide horizontal, rotational, and/or torsional stability to a rack as it is inserted into and removed from a home appliance. In this instance, the other rail could be a solid rail as illustrated in FIG. 2B. In other instances, such as the oven illustrated in FIG. 12, U-shaped rails may be located on both sides of the home appliance. Runners as shown in certain examples may be implemented on both sides of a rack. An example with U-shaped rails on both sides of the home appliance may provide even greater amounts of horizontal, rotational, and/or torsional stability to the rack as it is inserted into and removed from a home appliance.

Figure 11C:
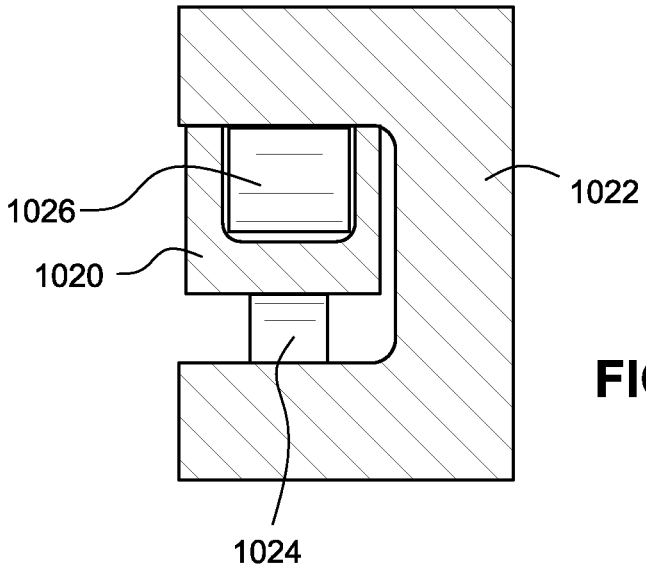
FIG. 11C is an illustrative cross-sectional view of an example runner engaging with an example rail.

It will be appreciated that while some example rails described and illustrated were upside down "U" shaped rails, in other examples the rails may be "flipped" and may be U shaped. FIG. 11C illustrates a cross-sectional view of an example rail and runner. In this example, the rail 1020 may be oriented such that a channel is formed on the top side of the rail (e.g., as opposed to the bottom side as shown in, for example, FIG. 3A). Accordingly, a runner 1022 may include a protrusion 1026 (e.g., a roller) on a top surface of the channel that is structured to engage with the formed channel of the rail 1020. Also, a protrusion 1024 may be included on the bottom surface of the runner 1022.

While rollers are used in several locations in the examples described above, other elements may be used in place of rollers to facilitate the sliding of a rack into and out of a home appliance. For example, simple roller balls resting in enclosures on a runner of a rack could be used in place of the rollers.

While the examples described herein have been applied to ovens, it will be appreciated that the rack mounting configurations could be applied to others types of home appliances with racks, such as dishwashers, microwave ovens, refrigerators, and/or freezers.

While the invention has been described in connection with what are presently considered to be the most practical and preferred examples, it is to be understood that the invention is not to be limited to the disclosed examples, but on the contrary, is intended to cover various modifications and equivalent arrangements.

What is claimed is:

1. A home appliance for the treatment of household items, comprising:

an enclosure;

at least one first rail disposed on a first inner sidewall of the enclosure, wherein a channel is formed in a surface of the at least one first rail;

at least one second rail disposed on a second inner sidewall of the enclosure; and a support element for supporting the household items that is slidably removable from the at least one first rail and the at least one second rail for smooth insertion and removal thereto, the support element including a first runner located on a first side of the support element and a second runner located on a second, opposite side of the support element, and wherein a channel is formed into an exterior side of each of the first and second runners, wherein at least one first projection is affixed to a first surface of the channel on the first runner, wherein at least one second projection is affixed a second surface that opposes the first surface of the channel of the first runner, wherein when the support element is mounted on the at least one first rail and the at least one second rail, the at least one first rail is received in the channel of the first runner, the at least one second rail is received in the channel on the second runner, and the at least one projection on the first surface of the channel of the first runner is received into the channel of the at least one first rail and the at least one second projection engages another surface of the at least one first rail such that the at least one first rail is sandwiched between the first and second projections.

2. The home appliance of claim 1 wherein the at least one projection on the first surface of the channel of the first runner comprises at least one roller.

3. The home appliance of claim 2 wherein the at least one roller has an axis of rotation that is substantially parallel to a plane formed by the first surface.

4. The home appliance of claim 2 wherein the at least one roller has an axis of rotation that is substantially perpendicular to a plane formed by the first surface.

5. The home appliance of claim 2 wherein the at least one roller includes a vertical axis roller and a horizontal axis roller, the vertical axis roller being configured to engage sidewalls of the channel on the surface of the at least one first rail, the horizontal axis roller having an axis of rotation that is substantially parallel to a plane formed by the first surface, the vertical axis roller having an axis of rotation that is substantially perpendicular to the axis of rotation of the horizontal axis roller.

6. The home appliance of claim 5 wherein a plurality of vertical axis rollers are spaced along the first surface of the channel of the first runner.

7. The home appliance of claim 2 wherein said another surface of the at least one first rail is a second surface of the first rail, and the at least one second projection on the second surface of the first runner includes a plurality of horizontal axis rollers structured to engage the second surface of the first rail, the horizontal axis rollers having an axis of rotation that is substantially parallel to a plane formed by the second surface of the channel of the first runner.

8. The home appliance of claim 2 wherein the second runner includes a plurality of horizontal axis rollers located on a surface of the channel of the second runner and structured to engage a surface of the second rail, the horizontal axis rollers having an axis of rotation that is substantially parallel to a plane formed by the surface of the channel of the second runner.

9. The home appliance of claim 8 wherein the channel of the second runner includes a plurality of horizontal axis rollers located on a bottom surface of the channel that are structured to engage a bottom surface of the second rail.

10. The home appliance of claim 1, wherein a channel is formed in a surface of the at least one second rail.

11. The home appliance of claim 10 wherein at least one projection is formed on a first surface of the channel of the second runner, and wherein the channel formed in the surface of the at least one second rail is structured to receive the at least one projection on the first surface of the channel of the second runner.

12. The home appliance of claim 11 wherein the at least one projection on the first surface of the first runner includes a first plurality of rollers and the at least one projection on the first surface of the second runner includes a second plurality of rollers.

13. The home appliance of claim 12, wherein the first and second plurality of rollers have a vertical axis of rotation, wherein the vertical axis of rotation for the first and second plurality of rollers is perpendicular to the bottom surfaces on the channels on the first and second runners, respectively.

14. The home appliance of claim 13, wherein the at least one second projection on the second surface of the first runner comprises a third plurality of rollers located on an upper surface of the channel on the first runner and a fourth plurality of rollers located on an upper surface forming a part of the channel of the second runner.

15. The home appliance of claim 14, wherein the third and fourth plurality of rollers have a horizontal axis of rotation, wherein the horizontal axis of rotation is parallel to surface upon which the rollers are located.

16. The home appliance of claim 1, wherein the at least one first rail comprises an inverted U-shaped rail.

17. The home appliance of claim 1, wherein the at least one first rail comprises an L-shaped rail that is affixed to the first inner sidewall of the enclosure such that the channel is formed between a downwardly depending leg of the L-shaped rail and the first inner sidewall.

18. The home appliance of claim 1, further comprising:

a heating element disposed in the enclosure and configured to provide heat to the household items.

19. A home appliance, comprising:

an enclosure;

a first rail disposed on a first inner sidewall of the enclosure, wherein a channel is formed on a bottom of the first rail;

a second rail disposed on a second inner sidewall of the enclosure that is opposite to the first inner sidewall; and a support element that is slidably mountable to the first and second rails for smooth insertion and removal thereto, the support element comprising:

a support surface, a first runner located on a first side of the support surface, wherein a first horizontal aperture is formed in a side of the first runner, the first rail being received in the first horizontal aperture when the support element is mounted on the first and second rails, and wherein at least one projection is affixed to a bottom surface that forms the first horizontal aperture, the at least one projection being received in the channel formed on the bottom of the first rail when the support element is mounted on the first and second rails, and a second runner located on a second side of the support surface, wherein a second horizontal aperture is formed on a side of the second runner, the second rail being received in the second aperture when the support element is mounted on the first and second rails, wherein the first runner includes at least one second projection affixed to a top surface formed by the first horizontal aperture such that the first rail is vertically sandwiched between the at least one second projection and the at least one projection when the support element is mounted.

20. The home appliance of claim 19, wherein the at least one projection comprises a plurality of rollers having an axis of rotation that is substantially perpendicular to a plane formed by the bottom surface of the first horizontal aperture.

21. The home appliance of claim 20, wherein the at least one projection further comprises at least one roller having an axis of rotation that is substantially parallel to the plane formed by the bottom surface of the first horizontal aperture.

22. The home appliance of claim 1, wherein a height of the at least one first projection is approximately the same as a height of the channel of the at least one first rail.

23. The home appliance of claim 19, wherein a cross-sectional profile of the channel formed on the bottom of the first rail matches a cross-sectional profile of the at least one projection located on the bottom surface of the first horizontal aperture.

* * * * *